US007223013B2

(12) United States Patent
Allen

(10) Patent No.: US 7,223,013 B2
(45) Date of Patent: May 29, 2007

(54) FIRST IN FIRST OUT HYDRATION TANKS

(76) Inventor: Thomas E. Allen, 9722 S. Oswego Ave., Tulsa, OK (US) 74137

( * ) Notice: Subject to any disclaimer, the term of this patent is extended or adjusted under 35 U.S.C. 154(b) by 373 days.

(21) Appl. No.: 10/820,602

(22) Filed: Apr. 8, 2004

(65) Prior Publication Data

US 2005/0226097 A1 Oct. 13, 2005

(51) Int. Cl.
*B01F 7/20* (2006.01)

(52) U.S. Cl. ..... 366/303; 366/307; 366/314

(58) Field of Classification Search ..... 366/64–67, 366/96–98, 302, 303, 307, 314; 241/188.2, 241/190

See application file for complete search history.

(56) References Cited

U.S. PATENT DOCUMENTS

| | | | | |
|---|---|---|---|---|
| 38,915 | A * | 6/1863 | Rowan | 366/303 |
| 1,451,424 | A * | 4/1923 | Head | 241/56 |
| 2,278,051 | A * | 3/1942 | Ambrose | 241/97 |
| 3,542,342 | A | 11/1970 | Barron | |
| 3,788,609 | A * | 1/1974 | Toczyski | 366/289 |
| 4,125,331 | A | 11/1978 | Chisholm | |
| 4,688,945 | A | 8/1987 | Brazelton et al. | |
| 4,838,701 | A | 6/1989 | Smith et al. | |
| 4,979,829 | A | 12/1990 | Allen | |
| 5,029,645 | A | 7/1991 | Allen | |
| 5,046,856 | A | 9/1991 | McIntire | |
| 5,064,582 | A | 11/1991 | Sutton et al. | |
| 5,103,908 | A | 4/1992 | Allen | |
| 5,135,968 | A | 8/1992 | Brazelton et al. | |
| 5,190,374 | A | 3/1993 | Harms et al. | |
| 5,382,411 | A | 1/1995 | Allen | |
| 5,383,725 | A | 1/1995 | Swisher, Jr. et al. | |
| 5,426,137 | A | 6/1995 | Allen | |
| 5,981,446 | A | 11/1999 | Qiu et al. | |
| 6,027,240 | A | 2/2000 | Han | |
| 6,280,076 | B1 * | 8/2001 | Muntener | 366/149 |

FOREIGN PATENT DOCUMENTS

| | | | |
|---|---|---|---|
| JP | 6-114254 | * | 4/1994 |
| JP | 2002-45671 | * | 2/2002 |

OTHER PUBLICATIONS

T.E. Allen, Pregel Blender Prototype Designed to Reduce Cost and Environmental Problems, Paper published for presentation at 1994 SPE Permian Basin Oil and Gas Recovery Conference in Midland Texas, Mar. 16-18, 1994.

* cited by examiner

*Primary Examiner*—Charles E. Cooley
(74) *Attorney, Agent, or Firm*—Molly D. McKay

(57) ABSTRACT

A hydration tank provided with an interior rotating vessel located between a stationary wall of the hydration tank and a stationary wall of a central inlet tube provided centrally within the tank. Liquid flows downward into the tank via a central inlet tube, then upward between the inlet tube and the rotating vessel, and then again downward between the rotating vessel and the tank wall to the exit. Horizontal vanes are provided on both the inside and outside of the rotating vessel that interleaf with horizontally extending stationary vanes provided on the wall of the tank and the central inlet tube. Together, the stationary and rotating vanes constantly mix the liquid in a direction that is normal to the direction of flow of the liquid without interfering with flow of the liquid through the tank.

7 Claims, 2 Drawing Sheets

FIRST IN FIRST OUT HYDRATION TANKS

CROSS-REFERENCE TO RELATED APPLICATIONS

The present invention is an improved hydration tank for use with Applicant's Gel Mixing System taught in U.S. patent application Ser. No. 10/426,742, now abandoned.

BACKGROUND OF THE INVENTION

1. Field of the Invention

The present invention relates to a first in first out hydration tank that prevents liquid flowing through the tank from stagnating in certain areas of the tank, thereby facilitating flow that is truly first in first out through the tank.

2. Description of the Related Art

In gel mixing systems, it is desirable to have first in first out hydration tanks so that gel mixtures flowing through the tanks have consistent and predictable residence time within each tank. Even if a traditional hydration tank has a defined flow circuit provided through the tank, such as the three tanks taught in FIG. 2 of Applicant's U.S. patent application Ser. No. 10/426,742, there can still be a problem when the fluid that is flowing through the tanks is a highly concentrated fracturing gel mixture.

The reason this is true is that fracturing gel made from guar is a non-Newtonian fluid. Newtonian fluids, such as water and oil, will flow whenever even a slight pressure is applied to the fluid. Non-Newtonian fluids, on the other hand, require that a certain threshold pressure be applied to them before they begin to flow. This is due to the yield point of the fluid. Thus, non-Newtonian fluids have a threshold pressure required to start them moving, and below which they may deform but will not move. This phenomenon is referred to as gel strength and is directly proportional to the force required to cause the fluid to start moving.

In the mixing system described in Applicant's U.S. patent application Ser. No. 10/426,742, a concentrated gel is prepared that can have significantly higher viscosity and gel strength than that of the final product. The concentrate allows greater hydration time in limited tank volume but has the problem of higher viscosities and gel strengths in the mixing and the hydration tanks.

If the fluid is not managed properly, parts of the tank will become gelled and motionless and will be difficult to get moving again. When gelation occurs, the objective of first in first out flow is defeated because the gelled fluid will remain in one place and the newly mixed fluids that enter the tank will bypass the gelled fluid. Thus, the tank is functionally smaller than its actual size since part of the fluid in the tank is not moving.

The present invention addresses this problem by stirring the fluid as it passes through the hydration tank, thereby preventing dead spots within the tank. By providing mixing that is normal to the nominal direction of flow, i.e. not forward or backward relative to the direction of flow through the tank and providing shear within virtually all of the volume, the mixing prevents the occurrence of dead spots or channeling within the flow path, while not moving some of the liquid towards the discharge port faster than other parts of the fluid volume, thereby insuring that all the fluid ends up with exactly the same residence time in the tank. By employing mixing that is normal to the flow of the liquid through the tank, all of the fluid flow paths through the tank move at a uniform velocity.

While the fluid is moving though the hydration tank, it is continuing to hydrate and thus continuingly increasing in viscosity. If the fluid does not keep moving uniformly through the hydration tank, it is possible that some parts of the fluid in the tank would develop greater viscosity due to slower velocity through the tank and therefore greater residence time. The slower moving volume within the tank will continue to develop higher viscosities which in turn tends to further slow its movement until eventually it could stop moving and become gelled. Once gelled, a much greater force is required to get the gel started moving again.

The present invention keeps all of the fluid moving at a uniform velocity so that there will not be areas with higher or lower viscosity at the same position within the flow path. Although viscosity will increase due to hydration from the entrance of the present tank to the exit, all fluid that is at the same position relative to the entrance and exit of the tank should have the same viscosity.

Still a further object of the present invention is an output from the tank that is uniform in its level of hydration. That is possible only if all of the liquid moves through the tank at the same velocity.

SUMMARY OF THE INVENTION

The present invention is a first in first out hydration tank that is provided with an interior rotating vessel located between the stationary wall of the hydration tank and the stationary wall of a central inlet tube provided in the center of the tank. The flow of liquid through the tank is downward inside the central inlet tube, then upward between the exterior surface of the inlet tube and an interior surface of the rotating vessel, then downward again between the exterior surface of the rotating vessel and the interior surface of the tank wall.

The rotating vessel is provided with vanes that rotate in conjunction with the rotating vessel. The rotating vanes extend horizontally from both the inside and outside surfaces of the wall of the rotating vessel and interleaf with horizontally extending stationary vanes provided on both the interior surface of the wall of the tank and on the exterior surface of the wall of the central inlet tube. Together, the stationary and rotating vanes function to constantly mix the liquid in a direction that is normal to the direction of flow of the liquid as the liquid passes through the tank. This mixing creates a constant sheer action within the fluid as the fluid travels through the tank, thereby preventing gelation of the hydrating fluid. Thus, the tank achieves a true first in first out flow pattern through the tank and a consistent and predictable residence time of the liquid within each tank even at low flow rates through the tank.

DETAILED DESCRIPTION OF THE PREFERRED EMBODIMENT

The Invention

Figure 1:
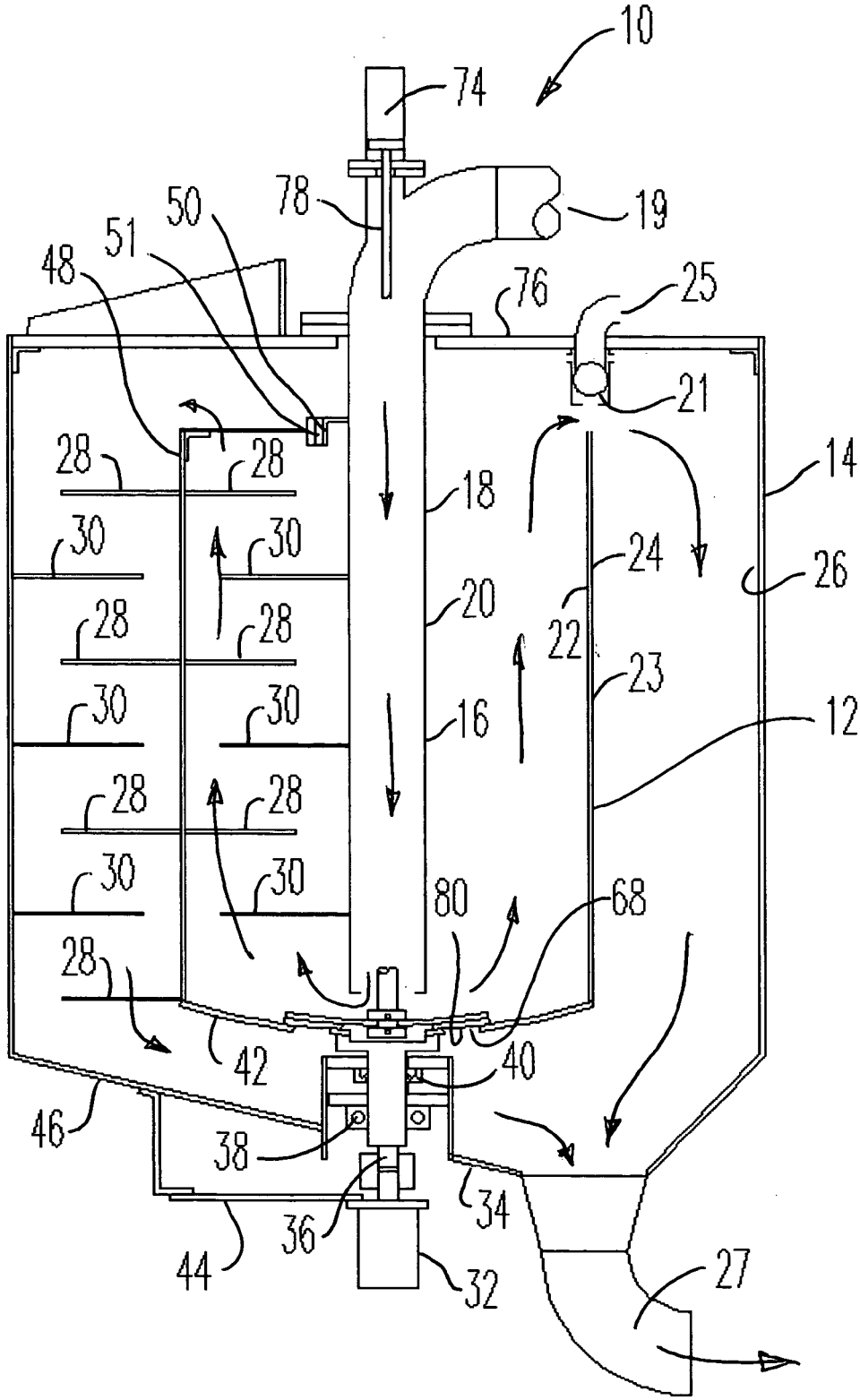
FIG. 1 is a partially cut away view of a first in first out hydration tank constructed in accordance with a preferred embodiment of the present invention.

Referring now to the drawings and initially to FIG. 1, there is illustrated a first in first out hydration tank 10 that is constructed in accordance with a preferred embodiment of the present invention. The tank 10 is provided internally with a rotating vessel 12 that is located between a stationary outside wall 14 of the hydration tank 10 and a stationary tube wall 16 of a central inlet tube 18 located centrally within the tank 10.

The tank 10 is designed for receiving a liquid mixture consisting of previously combined gel and dilution water and for maintaining the mixture in a first in first out flow though the tank 10 while the mixture hydrates. The flow of liquid, as shown by the arrows in FIGS. 1 and 2, through the tank 10 is from the inlet 19 of the tank 10 downward inside the central inlet tube 18, then reversing direction so that the liquid flows upward between the exterior surface 20 of the inlet tube 18 and an interior surface 22 of a side wall 23 of the rotating vessel 12, then once again reversing direction so that the liquid again flows downward between the exterior surface 24 of the side wall 23 of the rotating vessel 12 and the interior surface 26 of the outside tank wall 14 where the liquid flows out of the tank via a bottom outlet 27.

An air vent 25 is provided in the top of the tank 10 to allow air to escape the tank 10. The air vent 25 is designed with a ball float 21 that is designed to float on the fluid level in the tank 10 when the tank 10 becomes full of liquid. When the fluid level reaches the ball float 21, the ball float 21 moves upward, thereby closing the air vent 25 and allowing the tank 10 to continue to operate as a fluid filled or slightly pressurized tank until the fluid level again drops sufficiently to allow the ball float 21 to again move downward, thereby reopening the air vent 25. By having a closed tank, a tank level system is not required.

The rotating vessel 12 is provided with vanes 28, or alternately bars or rods on both the interior surface 22 and the exterior surface 24. The rotating vanes 28 rotate in conjunction with rotation of the rotating vessel 12. These rotating vanes 28 extend horizontally from the interior and exterior surfaces 22 and 24 of the wall 23 of the rotating vessel 12 and interleaf vertically with and are spaced apart from horizontally extending stationary vanes 30 provided on both the interior surface 26 of the outside wall 14 of the tank 10 and on the exterior surface 20 of the central inlet tube 18.

Together, the stationary and rotating vanes 30 and 28 function to constantly mix the liquid in a direction that is normal, i.e. perpendicular or at right angles, to the direction of flow of the liquid as the liquid passes through the tank. Thus, by constantly mixing the liquid as it flow through the tank, the tank 10 achieves a true first in first out flow pattern through the tank 10 and a consistent and predictable residence time of the liquid within the tank 10, even at low flow rates.

Although not illustrated, an alternate embodiment of the present invention can replace the stationary vanes 30 on the interior surface 26 and the exterior surface 20 with a coarse screen that covers the flow area but leaves radial slots so that the vessel 12 with its rotating bars 28 can be installed.

As illustrated in FIG. 1, the rotating vessel 12 is rotated within the tank wall 14 by means of a rotary motor 32. The rotational speed of the vessel 12 should not be high. The rotary motor 32 is designed to provide enough shear to keep the fluid moving and not gelling, but does not spin at high speed like a washing machine. The rotary motor 32 is attached centrally at the bottom 34 of the tank 10 and is located exterior to the outside wall 14 of the tank 10. The rotary motor 32 has a drive shaft 36 that extends through the outside wall 14 of the tank via a bearing 38 and seal 40 that are provided on the bottom 34 of the tank 10. After passing through the bearing 38 and seal 40, the drive shaft 36 attaches to the bottom 42 of the rotating vessel 12 where the rotating vessel 12 is rotatable supported from the bottom 34 of the outside wall 14 of the tank 10. When the rotary motor 32 is activated, the rotating vessel 12 is turned or rotated. The rotary motor 32 is provided with a torque arm 44 that attaches to the rotary motor 32 and to an exterior surface 46 of the outside wall 14 of the tank 10 as a means of preventing the rotary motor 32 from turning relative to the tank 10.

Figure 2:
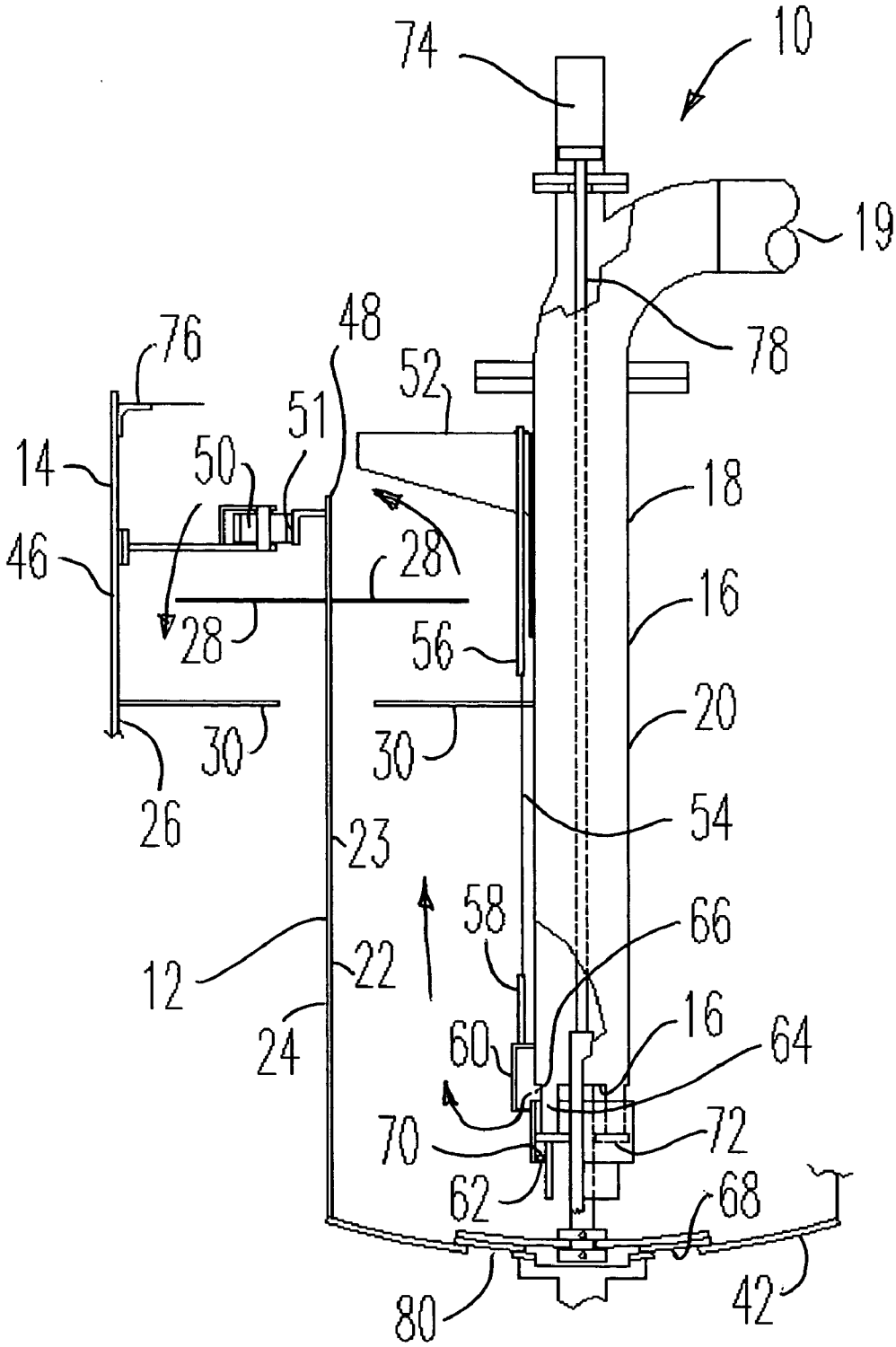
FIG. 2 is a partial view of the tank of FIG. 1, showing details of the roller bearings that stabilize the rotating vessel and also showing details of the float and valve to control the fluid level in the tank.

The top 48 of the rotating vessel 12 is stabilized by several roller bearings 50 that are either attached to the exterior surface 20 of the central inlet tube 18, as illustrated in FIG. 1, or alternately attached to the interior surface 26 of the outside wall 12, as illustrated in FIG. 2. The roller bearings 50 are provided at several locations around the tank 10 and they engage in rolling fashion a lip 51 provided on the top 48 of rotating vessel 12, as best illustrated in FIG. 2, in order to hold the rotating vessel 12 is a stable upright posture as the vessel 12 rotates within the tank 10.

Instead of providing the tank with an air vent 25, as illustrated in FIG. 2, the tank 10 can alternately be provided with a float 52 for regulating flow of liquid into the tank 10 so the liquid level within the tank 10 does not exceed a predetermined level. The float 52 movably attaches to the exterior surface 20 of the central inlet tube 18 so that the float 52 rises and falls relative to the central inlet tube 18 in conjunction with rise and fall of the liquid level in the tank 10. A float rod 54 attaches on one end 56 to the float 52 and on an opposite end 58 to a downwardly directed shield 60 so that the float rod 54 raises the shield 60 as the float 52 rises and lowers the shield 60 as the float 52 falls. The shield 60 is secured to a valve sleeve 62 that closely engages and encircles a lower end 64 of the tube wall 16 of the central inlet tube 18. The lower end 64 of the central inlet tube 18 is provided with valve openings 66 that extend through the tube wall 16 so that the valve sleeve 62 serves to open up or close off flow of liquid through the valve openings 66 in response to the lowering and raising of the float 52, respectively. Liquid must flow through the valve openings 66 in order to flow from out of the lower end 64 of the central inlet tube 18. As illustrated by the arrows in FIG. 2, once the liquid has passed through the valve openings 66, the shield 60 forces the liquid to flow downward until it encounters a bottom drain valve seal 68, and then from there it flows upward, as previously described.

The valve sleeve 62 is provided with a stop 70 that reversibly engages a closed bottom end 72 of the central inlet tube 18 to limit the upward movement of the valve sleeve 62 beyond its fully closed position relative to the valve openings 66.

Regardless of whether the tank 10 is provided with an air vent 25 or the float 52 for level control, the tank 10 is provided with the bottom drain valve seal 68 as a means of draining the rotating vessel 12. The bottom drain valve seal 68 is operated by a cylinder 74 that is located on the top 76 of the tank 10 and exterior to the tank 10. The cylinder 74 connects to the bottom drain valve seal 68 via a cylinder shaft 78. The bottom drain valve seal 68 closes against bottom openings 80 provided in the rotating vessel 12. The purpose of the bottom openings 80 is to provide a means of draining the rotating vessel 12 when desired. To drain the rotating vessel 12, the cylinder 74 is activated to lift and disengage the bottom drain valve seal 68 from the bottom openings 80. Likewise, to once again close the bottom openings 80, the cylinder 74 is reversed to lower the bottom drain valve seal 68 into a sealed engagement with the bottom openings 80.

Although the tank 10 has been described as having a rotating vessel 12 located internally, the invention is not so limited. The invention can alternately be practiced by employing a stationary inner vessel and a system of rotating stirring elements located within the tank so that the stirring elements agitate in a direction that is normal to the direction of flow of the liquid through the tank.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. First in first out hydration tank with a stationary outside tank wall, a stationary central inlet tube provided centrally within said outside tank wall, a vessel wall provided between said central inlet tube and said outside tank wall so that liquid flows in a downward direction within said inlet tube and then in an upward direction between said inlet tube and said vessel wall and then again in a downward direction between the vessel wall and the outside tank wall before exiting through an exit provided at the bottom of the outside tank wall wherein the improvement comprises:

means for mixing a liquid in a direction that is normal to a direction of flow of the liquid as the liquid passes between an inlet and an exit of a first in first out hydration tank, wherein the means for mixing a liquid in a direction that is normal to a direction of flow of the liquid as the liquid passes between an inlet and an exit of a first in first out hydration tank further comprises:

horizontally extending vanes provided on an outside tank wall and a central inlet tube that interleaf in spaced apart relationship with vanes provided on a rotating vessel wall located between the central inlet tube and the outside tank wall.

2. A first in first out hydration tank comprising:

a stationary outside tank wall, said tank wall provided with an exit provided at a bottom of the tank wall, a stationary central inlet tube provided centrally within said outside tank wall with an inlet provided at a top of the inlet tube, a vessel wall provided between said central inlet tube and said outside tank wall so that liquid flows from the inlet in a downward direction within said inlet tube and then in an upward direction between said inlet tube and said vessel wall and then again in a downward direction between the vessel wall and the outside tank wall before exiting through the exit, and said vessel wall rotating in a direction that is normal to the direction of liquid flow on either side of the vessel wall, vanes secured to and extending approximately horizontally from said rotating vessel wall, and stationary vanes secured to and extending approximately horizontally from said inlet tube and said outside tank wall so that the stationary vanes interleaf and are spaced apart from the vanes provided on said vessel wall.

3. A first in first out hydration tank according to claim 2 further comprising:

a float movably provided adjacent said inlet tube, a lower end of the inlet tube provided with valve openings through which liquid flows out of the inlet tube, a float rod connecting said float to a valve sleeve, and said valve sleeve movably located adjacent the valve openings as a means of dynamically controlling flow of liquid out of the inlet tube through the valve openings in response to variations in liquid level within the tank wall.

4. A first in first out hydration tank according to claim 3 further comprising:

a bottom of the vessel wall provided with bottom openings for draining liquid from within the vessel wall, a cylinder provided on top of said tank wall, a cylinder shaft attached on one end to said cylinder and attached on an opposite end to a bottom drain valve seal to operably connect said cylinder and said bottom drain valve seal, and said bottom drain valve seal reversibly sealing with said bottom openings as a means of alternately preventing and permitting liquid flow through said bottom openings.

5. A first in first out hydration tank according to claim 2 further comprising:

a rotary motor provided exteriorly at a bottom of the outside tank wall, and a drive shaft attached to said rotary motor and to a bottom of the vessel wall as a means of rotating said vessel wall.

6. A first in first out hydration tank according to claim 5 further comprising:

bearing and a seal provided in the bottom of the outside tank wall, and said drive shaft extending through said bearing and said seal.

7. A first in first out hydration tank according to claim 2 further comprising:

an air vent provided in the top of the outside tank wall, said air vent provided with a movable ball float that floats on a liquid level in the tank and closes the air vent when it moves upward and reopens the air vent when it moves downward.

* * * * *